United States Patent [19]

Nous

[11] Patent Number: 4,990,751

[45] Date of Patent: Feb. 5, 1991

[54] DRIER DRUM, IN PARTICULAR FOR PAPERMAKING MACHINES

[75] Inventor: Jean P. Nous, Franqueville-St-Pierre, France

[73] Assignee: S.E.M.T.I. Societe a Responsabilite Limitee, Grand-Quevilly, France

[21] Appl. No.: 411,697

[22] Filed: Sep. 25, 1989

[51] Int. Cl.[5] ..... B21B 27/08; H05B 3/02

[52] U.S. Cl. ..... 219/469; 432/228

[58] Field of Search ..... 219/469, 470, 471, 216, 219/388; 355/290; 432/60, 228; 34/110

[56] References Cited

U.S. PATENT DOCUMENTS

| | | | |
|---|---|---|---|
| 1,978,081 | 10/1934 | Hanson | 219/470 |
| 2,571,426 | 10/1951 | Doniak . | |
| 2,586,829 | 2/1952 | Kelsey | 34/124 |
| 3,216,489 | 11/1965 | Norton . | |
| 3,376,407 | 4/1968 | Wagner | 219/470 |
| 3,624,353 | 11/1971 | Bjorklund | 219/470 |
| 3,805,020 | 4/1974 | Bates | 219/471 |
| 4,163,892 | 8/1979 | Komatsu | 219/216 |
| 4,535,230 | 8/1985 | Brieu | 219/470 |
| 4,560,860 | 12/1985 | Fauser | 219/470 |

FOREIGN PATENT DOCUMENTS

| | | |
|---|---|---|
| 0252572 | 1/1988 | European Pat. Off. . |
| 3033689 | 4/1982 | Fed. Rep. of Germany . |
| 3511903 | 10/1986 | Fed. Rep. of Germany . |

*Primary Examiner*—Teresa J. Walberg

*Attorney, Agent, or Firm*—Bachman & LaPointe

[57] ABSTRACT

A drier drum, in particular for papermaking machines, for textile machines and the like, comprises a drum cylinder, end flanges carrying the drum cylinder, a drive system mechanically coupled to at least one of the flanges to rotate it and heating means. The drum comprises a fixed refractory material cylindrical sleeve covered with a heat reflecting coating disposed coaxially inside the drum cylinder and heating means comprising main electrical heating elements of elongate shape adapted to be energized continuously during functioning thereof and profile correcting electrical heating elements of elongate shape adapted to be energized selectively. At least some of the main heating elements are longer than any of the profile correcting heating elements. The electrical heating elements are carried by the cylindrical sleeve.

9 Claims, 2 Drawing Sheets

DRIER DRUM, IN PARTICULAR FOR PAPERMAKING MACHINES

BACKGROUND OF THE INVENTION

1. Field of the invention

The invention concerns drier drums, in particular drier drums for papermaking machines, for the textile industry and the like.

2. Description of the Prior Art

Known drying drums are generally heated by steam fed under pressure into their enclosure; different heating cycles are possible if the pressure of the input steam is modulated.

In applications where it is necessary to modify the drying capacity in each section along all the length of the "table" of the drum, to provide for controlling the moisture profile or, to use the converse concept, the dryness of the product to be dried (this is often the case in the field of papermaking), there are currently numerous possibilities:

to add steam blower manifolds outside the drum; this solution is somewhat impractical and difficult to adjust;

to integrate electrical heating elements into the drum; in the event of irregular or defective functioning it is necessary to demount a large part of the drum to service the complementary heating device;

to create electromagnetically induced Eddy currents outside or inside the drum cylinder; this solution implies a deformation of the ideal shape of the drum cylinder.

An object of the invention is to remedy these disadvantages and to enable known drier drums to be retrofitted after manufacture with a heating device for controlling the profile subject to detail or at most limited modifications.

SUMMARY OF THE INVENTION

To this end, the invention concerns a drier drum, in particular for papermaking machines, for textile machines and the like, comprising a drum cylinder, end flanges carrying said drum cylinder, drive means mechanically coupled to at least one of said flanges to rotate it, and heating means, characterized in that the drum comprises a fixed refractory material cylindrical sleeve covered with a heat reflecting coating disposed coaxially inside said drum cylinder and heating means comprising main electrical heating elements of elongate shape adapted to be energized continuously during functioning thereof and profile correcting electrical heating elements of elongate shape adapted to be energized selectively, at least some of the main heating elements being longer than any of the profile correcting heating elements and said electrical heating elements being carried by said cylindrical sleeve.

This structure makes it possible to energize all or some of the main heating elements as required.

Also, because the elements are carried by a fixed sleeve and only the drum cylinder turns, the original drum cylinder may be retained in the case of fitting out an existing drum.

In accordance with advantageous characteristics of the invention this structure also makes it possible for the two flanges at the opposite ends of the drum cylinder to be carried by a fixed shaft which also carries inside the drum cylinder a body made up of inside and outside jackets, the cylindrical sleeve being formed by part of the outside jacket which is made up of a plurality of circumferentially juxtaposed heating panels fixed to the jacket by demountable fixing devices enabling the panels to be separated from the jacket.

In this way the drum may be demounted extremely rapidly to carry out servicing and maintenance operations.

Other characteristics and advantages of the invention will emerge from the following description given by way of non-limiting example with reference to one embodiment shown in the appended diagrammatic drawings.

DETAILED DESCRIPTION OF THE INVENTION

Figure 1:
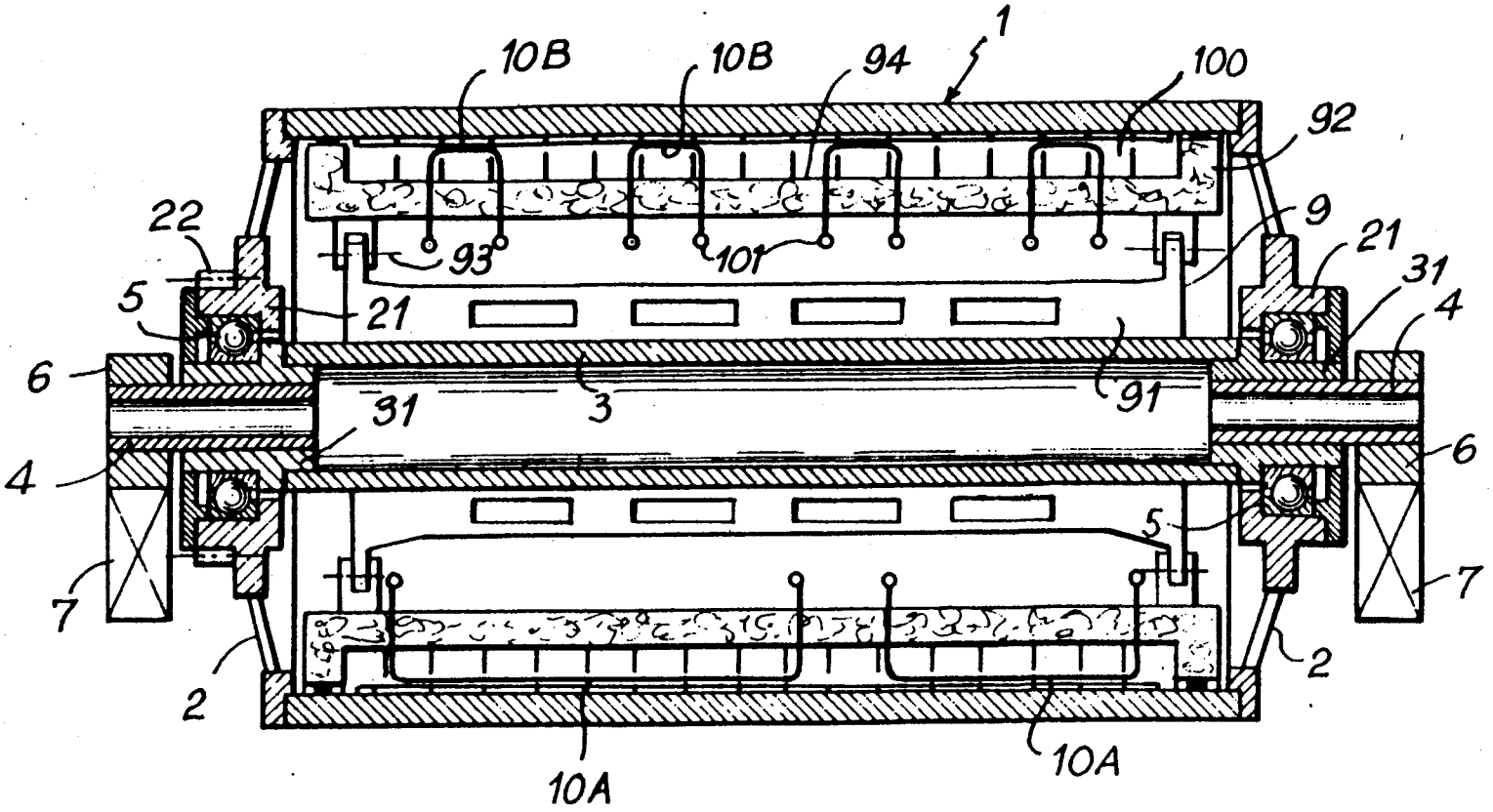
FIG. 1 is a longitudinal cross-section through a drier drum in accordance with the invention.

The drum in accordance with the invention for drying paper pulp or the like shown in FIG. 1 comprises a rotating outer drum cylinder 1 the periphery of which constitutes the "table" of the drum which supports the paper pulp or other product to be dried; this tubular drum cylinder is cylindrical in shape; its opposite ends are closed by flanges 2 adapted to compensate for expansion of the drum cylinder and incorporating hubs 21 of which one incorporates a toothed wheel 22 through which the drum cylinder is rotated by motor drive means; the hubs 21 are therefore mounted to rotate on a fixed tubular shaft 3, about opposite ends 31 of the shaft 3 which serves as a supporting framework for heating elements, as will be described later; the hubs 21 are mounted to rotate on the ends 31 of the hollow shaft 3 by means of respective ball bearings 5 at the driving end and the transmission end of the drum; the central part of the shaft 3 and its ends 31 are made as three separate parts attached together by hot sleeving or by welding; the ends 31 of the shaft 3 which carry the hubs 21 of the flanges 2 are of smaller diameter than its central part and in contact with the latter through a centering member inserted into the central part and a supporting base having an outside diameter substantially equal to that of this central part. A bush 4 is housed inside each end 31; the bush 4 is mounted in the end 31 in such a way as to be fastened to it when the drum is operating but so that the end 31 and all of the shaft 3 can be rotated independently of the bush 4 during any necessary maintenance operations, for example to bring a defective element opposite an access formed in the corresponding flange, in order to withdraw it from the drum. The free ends of the bushes 4 are housed in casings 6 for fixing the drum as a whole to longitudinal drum support members 7 carried by a supporting framework (not shown).

The central part of the shaft 3 carries a hollow heating body 9 comprising a tubular inside jacket 91 and a tubular outside jacket 92 in a thermally and electrically insulative material, attached by demountable fixing devices 93; the outside jacket is made up of heating elements in the form of panels serving as supports for elongate electrical heating elements, to be more precise main heating elements 10A and profile control heating elements lOB; the demountable fixing devices 93 enable the separation and extraction of the heating panels of which there are, for example, eight in circumferential sequence to constitute the outside jacket, which corresponds to an angle of 45 degrees subtended at the center by each panel; the extraction of the heating panels can be facilitated by the fact that the flanges 2 are themselves in a number of parts, preferably in as many juxtaposed parts as the outside jacket, for example eight parts arranged as circular sectors each having an angle at the center of 45 degrees; another possibility is for the flanges 2 to incorporate openings of sufficiently large size to enable the heating elements to pass through; the elements 10A, lOB extend longitudinally relative to the heating body, along generatrices of an imaginary cylinder, possibly with more than one element disposed on the same generatrix; the end parts of each element are bent at 90° to pass through the thickness of the outside jacket 92, and their ends proper terminate between the two jackets 91, 92 and are each provided with an electrical connection lug 101 for supplying them with electrical power. The insulative outside jacket 92, and in particular each heating panel, has a U-shape profile in longitudinal cross-section and its horizontal part forms a sleeve around the inside jacket; it is this sleeve which carries the elements 10A, 10B; applied to the outside surface of this jacket is a heat reflector 94, the role of which is to reflect towards the drum cylinder the heat emitted into the heating chamber 100 defined between the reflector 94 and the inside surface of the drum cylinder 1 by the electrical heating elements 10A, 10B carried by the sleeve.

The inside surface of the drum cylinder 1 (FIG. 2) is subdivided internally, for example by means of attached ribs or bars 11 so that, the elements being fixed like the jackets and all the central part of the drum, when the drum turns there is created a sort of turbine provoking circulation of air around the electrical heating elements, enabling the radiation from each element to reach the inside wall of the drum cylinder 1 and the reflector 94 preferably in line with the active heating surface of the elements 10A, 10B, so that the drum cylinder is heated annularly. The turbine significantly increases both efficiency and reliability, which is of particular benefit in the case of large-scale applications.

The distribution of the elements in the axial and circumferential directions enables uniform or variable heating of all the surface of the drum cylinder, the number, size, circumferential pitch and distribution of the elements being computed according to the required evaporation capacity and the size of the transverse sections heating of which is to be controlled. The electrical heating elements are supplied with electrical power selectively, separately or in groups, for the main heating of the drier drum and for heating the transverse drying profile control sections. Generally speaking, the main heating elements 10A are relatively long to create uniform heating, and in particular the shortest of them are at least as long as the profile correction elements 10B, which are all of the same length, which is relatively short with a view to localized action on the drum.

The supply of electrical power to one or other of the elements may be selected manually or automatically by means of contactors of current variators.

The supply of power to the electrical heating elements may be controlled by an automatic controller on the basis of data comprising information on the dryness of the product to be dried, obtained either by means of laboratory measurements or by means for continuously measuring the moisture content of the product.

In the case of fitting out an existing installation, the rotating drum cylinder is retained; on the other hand, all of the fixed structure that it contains, if it is not suitable to be used in accordance with the invention, may be changed and so all or part of this structure can be replaced with elements in accordance with the invention.

Figure 2:
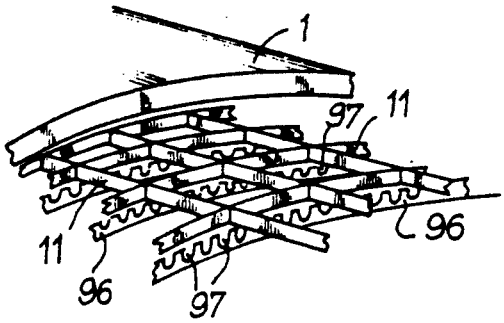
FIG. 2 is a perspective view showing one detail of the drum from FIG. 1
Figure 3:
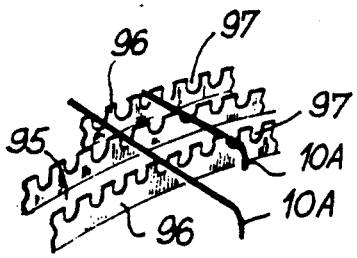
FIG. 3 is a perspective view showing another detail of the drum from FIG. 1.

Within the drum cylinder 1 there is in particular the device forming the turbine as already described, which is preferably of squirrel cage form (FIG. 2). To be more precise, the inside surface of the drum cylinder then carries subdivision means in the form of attached ribs or bars 11, longitudinally and circumferentially arranged to define between them square or rectangular cells. The periphery of the sleeve (to be more precise that of the reflector 94) is provided with channels 95 (FIGS. 2 and 3) extending circumferentially and channelling section by section the heat from the elements towards the cells, in order that they should not fuse laterally; these channels 95 are defined by the gaps between regularly spaced circumferential edges 96 along the length of the insulative sleeve facing the circumferential bars 11; the edges 96 incorporate regularly spaced notches 97 along their periphery and the notches of the successive edges along the sleeve are aligned parallel to the longitudinal axis of the drum; the notches 97 in question are intended to accommodate the central parts of the electrical heating elements 10A, 10B. Depending on the length of the element, it straddles two, three or four or more edges, passing through the notches therein, and its inwardly bent end parts pass around the two end edges (FIG. 3).

The electrical heating elements 10A, 10B comprises folded cylindrical bars of various lengths, these lengths preferably being multiples of each other. The length of the shortest element, which is therefore the "module", so to speak, may be 230 mm, for example; this is the length of the profile control elements 10B. The main heating elements 10A can have lengths in the order of 230 mm, 460 mm, 690 mm, 920 mm, 1 150 mm, 1 380 mm, 1 610 mm, etc.

The bent parts at the ends of the electrical heating elements pass through the sleeve by means of cylindrical housings extending through the thickness of the glass foam of which it is made between its inside and outside surfaces which are of sheetmetal braced to each other by angle-irons, for example, welded to the sheetmetal; as already mentioned, the outside surface is surrounded by an aluminum or other reflective material reflector 94 with the appropriate polish and is braced relative to the reflector by means of insulative washers surrounding the heating elements 10A, lOB in this region; the devices 93 fixing the elements to the sleeve naturally allow for expansion due to variations in temperature and therefore require a "sliding" fixing enabling longitudinal expansion of the elements, for example by means of oblong holes, and by providing guide spacer rings for the end parts of the elements along the guide slot created in this way.

Figure 4:
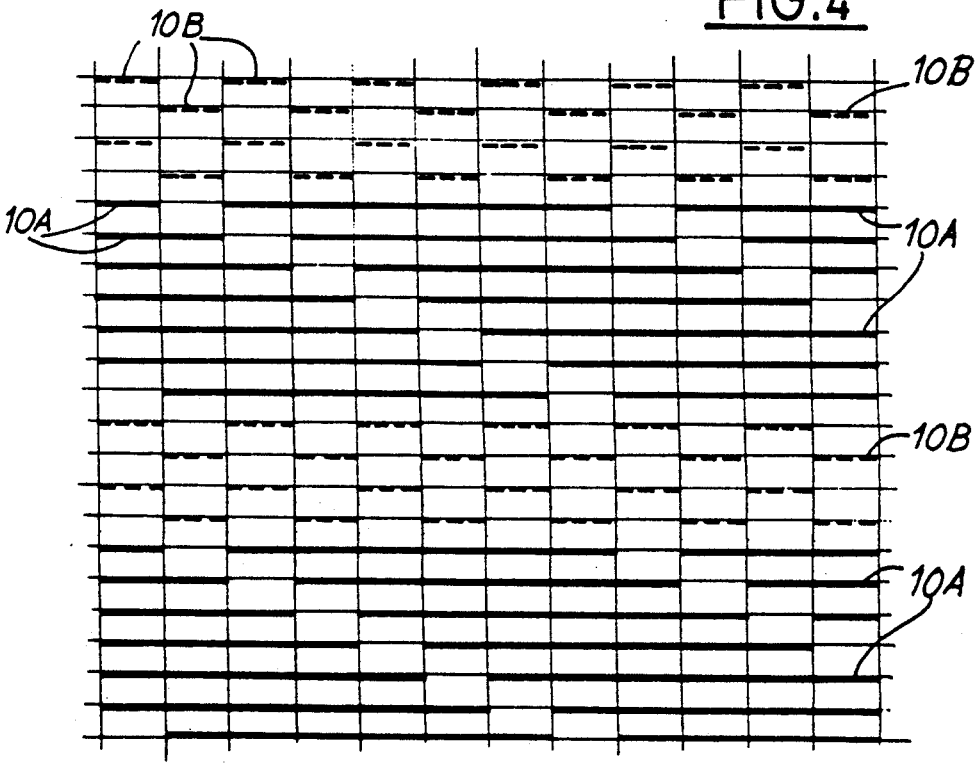
FIG. 4 is a diagram showing developed in the flat the arrangement of the heating elements over an angularly limited part of the periphery of the refractory sleeve.

One example of the arrangement of the elements 10A, lOB on the periphery of the sleeve is shown developed "in the flat" in FIG. 4, which shows only two "heating steps", by which is meant two identical areas in circumferential sequence over the whole of the sleeve the length of which corresponds to the machine width of the product to be dried.

Thus there follow on in sequence over a heating step four generatrices of six profile control elements 10B the length of which is one module, the elements being disposed in a quincunx arrangement (the spaces between the successive elements on the same generatrix are themselves equal to one module); with regard to the main heating elements 10A the spaces between successive elements on the same generatrix are also equal to one module and the elements are offset longitudinally by one module each time. Thus on the fifth generatrix there are an element of one module, a space, an element of six modules, a space and an element of three modules; on the sixth generatrix there are successively an element of two modules, an element of six modules and an element of two modules (naturally with the same spaces as previously); on the seventh generatrix: three modules, six modules, one module; on the eighth: four and six; on the ninth: five and six; on the tenth: six and five; on the eleventh: first a space and then six and four modules.

It is also possible to provide gaps between elements on the same generatrix which are equal to a multiple of the module (equal to two modules, for example).

An example with spaces of two modules is now given for a product 2 668 mm wide, a step of 13 generatrices and profile control elements 230 mm long, the maximum length of the main heating elements being 1 150 mm. There are therefore in succession: one profile correction generatrix: one module, a space, then three modules naturally separated by spaces; main heating: one module, five modules, two modules; profile correction: a half-space (thus only one module), then four modules separated by a space; main heating: two modules, five modules, one module; profile correction: a space, four separate modules; main heating: three modules, five modules; profile correction: four separate modules; main heating: four modules, five modules; profile correction: a half-space, four separate modules; main heating: five modules, five modules; profile correction: a space, four separate modules; main heating: a half-space, five modules, four modules; main heating: a space, five modules, three modules.

With an installation of this kind the profile adjustment capacity is 2/7 (28.6%); the maximum heating power at the surface of the drier is 6 W/cm$^2$ (on the basis of a drier 3.6 m in diameter) and the average power is 3 W/cm$^2$; the generatrices being spaced by 3.2 cm, and the step being 13 generatrices, the latter corresponds to 41.6 cm. The power over one step is therefore 249.6 Watts. The power per cm$^2$ of element at the surface of the drier is 7.13 W/cm$^2$ (which value has to be divided by the convection/conduction loss coefficient).

Other arrangements of the elements are naturally possible without departing from the scope of the invention and yield numerical characteristics differing only slightly from those stated above.

For example, for profile correction elements also 230 mm long but with a maximum main heating element length of 1 610 mm, still corresponding to a product 2 660 mm wide, a profile adjustment capacity of 2/9 (22.2%) can be obtained, a heating step of 15 generatrices (48 centimeters) and a power at the surface of the drier of 6.4 W per element For a drier 3.6 meters in diameter there are therefore 24 steps, that is to say three per heating panel assuming that the heating body 9 comprises eight panels each subtending an angle of 45° (see above) Tolerating an aperture dead area of 15 cm, a diameter of the heating surface of approximately 4.05 meters is obtained As seen, the profile adjustment capacity is then 22.2%, while when all the main heating elements are energized 77.8% of the heat is obtained. The adjustment capacity (resolution) is 0.46% and by coupling the heating elements two by two a regulation step of 0.92% is obtained. With regard to the main heating, the regulation step is 1/24, (4.167%) and it is therefore possible to obtain total main heating steps of 4.167% and to obtain a localized increase as required by means of the profile adjustment elements in additional steps of 0.92%. Under these conditions, a power of 0.736 kW per profile correction element is required, that is a total of 17.7 Kw per step and per phase for the profile correction heating and of 61.8 kW per step and per phase for the main heating. A good solution is to supply each of the three heating steps of a panel from a different phase of a three-phase mains electrical power supply, so that the power per phase is 636 kW; assuming an efficiency of 75%, the power consumed is 850 kW. The total power for all three phases is then 2 550 kW, giving a power of 950 kW per meter width for a paper product 2.668 meters wide.

Of course, the invention is not limited to the embodiment describe and shown and other embodiments could be put forward without departing from the scope of the invention. Particular note should be given to the simplicity of intervention on the elements 10A, 10B in the case of a fault or for routine servicing since, to obtain access to them, it is sufficient to demount one part of the lateral flange 2 at the driving end and to withdraw the heating panels through the same end of the drum.

WHAT IS CLAIMED IS:

1. A drier drum, in particular for papermaking machines, for textile machines and the like, comprising a drum cylinder, end flanges carrying said drum cylinder, drive means mechanically coupled to at least one of said flanges to rotate it, and heating means, characterized in that the drum comprises a fixed refractory material cylindrical sleeve covered with a heat reflecting coating disposed coaxially inside said drum cylinder and heating means comprising main electrical heating elements of elongate shape adapted to be energized continuously during functioning thereof and profile correcting electrical heating elements of elongate shape adapted to be energized selectively, at least some of the main heating elements being longer than any of the profile correcting heating elements and said electrical heating elements being carried by said cylindrical sleeve.

2. Dryer drum according to claim 1 further comprising a fixed shaft on which said two flanges rotate and a body on said shaft inside said drum cylinder comprising inside and outside jackets, said cylindrical sleeve comprising part of said outside jacket

3. Dryer drum according to claim 2 wherein said outside jacket is made up of heating panels attached to said inside jacket by demountable fixing devices.

4. Dryer drum according to claim 1 further comprising a tubular jacket inside said drum cylinder made up of circumferentially disposed heating panels, said cylindrical sleeve comprising a central part of said jacket.

5. Dryer drum according to claim 1 wherein said electrical heating elements have end portions bent back and attached to said sleeve.

6. Dryer drum according to claim 1 wherein said flanges each comprise a hub at least one of which incorporates a toothed wheel adapted to be driven by motor drive means, a fixed shaft and ball bearings by means of which said hubs are mounted on said fixed shaft.

7. Dryer drum according to claim 1 further comprising subdivision means on its cylindrical inside surface.

8. Dryer drum according to claim 1 wherein said reflector comprises circumferential channels at its periphery adapted to channel section by section the heat produced by said elements towards the drum cylinder.

9. Dryer drum according to claim 1 wherein said main heating elements have a length that is a multiple of the length of said profile correction heating elements, the multiplier being an integer at least equal to 1.

* * * * *